United States Patent [19]

Murphy

[11] Patent Number: 4,753,579

[45] **Date of Patent: * Jun. 28, 1988**

[54] ULTRASONIC RESONANT DEVICE

[75] Inventor: Donald Murphy, Wellesley, Mass.

[73] Assignee: Piezo Electric Products, Inc., Cambridge, Mass.

[ * ] Notice: The portion of the term of this patent subsequent to Aug. 4, 2004 has been disclaimed.

[21] Appl. No.: 884,325

[22] Filed: Jul. 10, 1986

Related U.S. Application Data

[63] Continuation-in-part of Ser. No. 821,863, Jan. 22, 1986, Pat. No. 4,684,328, which is a continuation of Ser. No. 625,704, Jun. 28, 1984, abandoned.

[51] Int. Cl.[4] ..... F04B 17/00

[52] U.S. Cl. ..... 417/322; 417/410; 310/330; 261/99; 239/102.2

[58] Field of Search ..... 417/322, 410, 413, 436, 417/240, 241; 416/3, 79, 81, 82, 83; 310/328, 330, 332, 348, 317; 261/99, DIG. 48, 81; 239/102.2

[56] References Cited

U.S. PATENT DOCUMENTS

| | | | |
|---|---|---|---|
| 2,932,494 | 4/1960 | Wales | 416/81 |
| 3,040,976 | 6/1962 | De Mattos | 417/436 |
| 4,038,570 | 7/1977 | Durley | 310/323 |
| 4,054,848 | 10/1977 | Akita | 310/317 |
| 4,085,893 | 4/1978 | Durley | 261/DIG. 48 |
| 4,193,009 | 3/1980 | Durley | 310/317 |
| 4,301,093 | 11/1981 | Eck | 261/99 |
| 4,342,936 | 8/1982 | Marcus et al. | 310/330 |
| 4,498,089 | 2/1985 | Scardovi | 310/317 |
| 4,498,851 | 2/1985 | Kolm et al. | 417/322 |

FOREIGN PATENT DOCUMENTS

| | | | |
|---|---|---|---|
| 477143 | 12/1914 | France | 416/83 |
| 80/02445 | 11/1980 | PCT Int'l Appl. | 417/322 |
| 289372 | 3/1953 | Switzerland | 417/436 |
| 2044705 | 10/1980 | United Kingdom | 416/79 |
| 2049594 | 12/1980 | United Kingdom | 416/79 |
| 2071924 | 9/1981 | United Kingdom | 310/332 |

OTHER PUBLICATIONS

Fitzpatrick, "Natural Flight & Related Aeronautics," *Institute of the Aeronautical Sciences,* 7-1952, p. 5.

"A Piezoelectric Cooling Fan", *Computers & Electronics,* 3-1983, p. 104.

Toda, "Vibrational Fan Using the Piezoelectric Polymer $PVF_2$", *Proceedings of the IEEE,* vol. 67, 8-1979, p. 1171.

*Primary Examiner*—Carlton R. Croyle

*Assistant Examiner*—Donald E. Stout

*Attorney, Agent, or Firm*—Joseph S. Iandiorio; William E. Noonan; Douglas E. Denninger

[57] ABSTRACT

An ultrasonic wave generator includes a resonant member tapered to a thin edge, the member having a Q of about 300 or more.

19 Claims, 3 Drawing Sheets

ULTRASONIC RESONANT DEVICE

RELATED CASES

This application is a continuation-in-part of Ser. No. 06/821,863 filed Jan. 22, 1986, now U.S. Pat. No. 4,684,328, which is a continuation of Ser. No. 06/625,704, filed June 28, 1984, abandoned.

FIELD OF INVENTION

This invention relates to resonant devices and ultrasonic transducers and more particularly to transducers for efficiently producing periodic vibrations having frequencies in the ultrasonic region.

BACKGROUND OF THE INVENTION

Piezoelectric blade blowers are known which are much smaller than the smallest rotary fans and are used to cool electronic equipment. These blowers are highly efficient, have long life, generate little noise or magnetic interference and are approximately two inches by one inch by three-fourths of an inch in size. However, they too have drawbacks. They are not small enough for direct mounting on printed circuit boards and electrical noise in the circuit boards as well as requiring that a 115-volt source be made available at the board. Attempts to use a piezoelectric crystal directly to pump air by acoustic streaming have also been less than successful because large crystals are required which are difficult and expensive to obtain in production. Acoustic streaming results from the fact that air accelerated by an oscillating surface does not reverse its direction when the surface does, due to inertia and compressibility, and is further complicated at higher amplitudes by turbulence and vortex formation.

The use of ultrasonic energy to vaporize a fluid such as water is known in the art. For example, home humidifiers utilize transducers driven at ultrasonic frequencies to convert water into water vapor which is blown by a fan into the room to increase the humidity level. It is also known to utilize ultrasonic energy to vaporize fluid such as various fragrances by applying ultrasonic energy to a wick element which feeds appropriately small quantities of fluid from a reservoir to an ultrasonic transducer for producing ultrasonic vibrations which are applied to the wick member. An improved atomizer is however needed for vaporizing those liquids which are not volatile enough to be readily vaporized in accordance with prior art ultrasonic transducers. Furthermore, it is also desirable to produce highly efficient vaporizers for vaporizing such liquids as various fragrances, utilizing low voltage sources such as nine volt batteries.

SUMMARY OF INVENTION

It is therefore an object of this invention to provide an improved ultrasonic resonant member.

It is also an object of this invention to provide an improved smaller, highly efficient, high velocity acoustic pump.

It is a further object of this invention to provide such a pump which may be mounted directly to a printed circuit board and is comparable in size to the components it cools.

It is a further object of this invention to provide such a pump which operates on low voltage.

It is a further object of this invention to provide such a pump which operates in the ultrasonic range virtually inaudibly and without vibration.

It is a further object of this invention to provide such a pump which produces very high airflow.

It is a further object of this invention to provide such a pump which has virtually unlimited service life, no magnetic disturbance, no heat generation and does not draw a high starting current.

It is a further object of this invention to provide such a pump which is mountable on a printed circuit board and pumps parallel to the board.

It is further object of this invention to provide such a pump which may make use of acoustic streaming.

It is yet a further object of this invention to provide a vaporizer particularly suitable for vaporizing liquid fragrances which are not volatile enough to be readily vaporized in accordance with prior art ultrasonic transducers at high efficiency, and which utilize a low voltage, inexpensive power supply such as a nine volt battery.

This invention results from the realization that a truly effective, small, high-velocity, high-volume resonant device can be made by using a resonant member with low internal damping and tapered to a thin edge, which resonates in an open node line pattern that intersects the thin edge.

The invention features in one embodiment, an acoustic air pump which includes a resonant member with low internal damping and asymmetrically tapered to a thin edge. A piezoelectric driver is mounted on the resonant member, and means are provided for applying a pulsating voltage to the piezoelectric driver in the resonant range of the resonant member for vibrating the resonant member and pumping fluid away from the thin edge.

In accordance with another embodiment, this invention features an atomizer for converting a liquid into a vapor in a highly efficient manner. The liquid is supplied to a portion of the resonant member adjacent the thin edge thereof, at a flow rate to produce atomization of the liquid. A battery operated voltage driver circuit produces a pulse train having voltage pulses of about plus and minus nine volts, which pulse train is applied to a thin piezoelectric element affixed to the resonant member, and having a substantially smaller mass than the resonant member, to permit low voltage operation of the piezoelectric element. Preferably, the pulse train is swept in frequency between twenty and eighty killohertz to insure that the resonant member will be driven at its resonant frequency, regardless of variation in the mechanical loading of the resonant member.

In preferred embodiments of both the acoustic blower pump and the vaporizer, the resonant member, driven by the thin piezoelectric driver element, has a Q of greater than three hundred, and is preferably of either tempered aluminum alloy, carbon steel, glass, or ceramic. The preferred materials, may have Q factors as high as one thousand, and also have high stiffness to density ratios of at least $2\times10^9$ dyne-cm/gram.

In preferred embodiments, the piezoelectric driver is mounted on the resonant member to cause the resonant member to vibrate in a node line pattern which intersects with the thin edge. The node line may be an open node line pattern, may be generally circular and may have two inflection points near its intersection with the thin edge. The driver element is mounted remote from the thin edge, and a perforated plate may be mounted on the resonant member above the inflection points. The perforated plate may also be mounted below the tapered surface and may be planar or have other configurations, such as an inverted V channel.

A perforated plate may be spaced above the tapered surface. The perforated plate is located at a position of dynamic equilibrium between the acoustic pressure exerted away from the surface and the recoil pressure exerted toward the tapered surface. The perforated plate may be loosely mounted above the tapered surface to permit the plate to seek its position of dynamic equilibrium between the acoustic pressure exerted away from the surface and the recoil pressure exerted toward the tapered surface.

The resonant member may be asymmetrically tapered to two thin edges and it may include a generally planar section from which the tapered portion extends. The piezoelectric driver may be mounted on the bottom of the resonant member, on the top or on a side. The means for applying the pulse train may include an electrode on the opposite side of the piezoelectric river. The perforated plate may be made of metal, may include approximately 270 holes per square inch, and the holes may be approximately 0.007 to 0.01 inch in diameter. The perforations may be formed with generally coinical walls converging away from the tapered surface.

DISCLOSURE OF PREFERRED EMBODIMENT

Other objects, features and advantages will occur from the following description of preferred embodiments and the accompanying drawings, in which.

Figure 1:
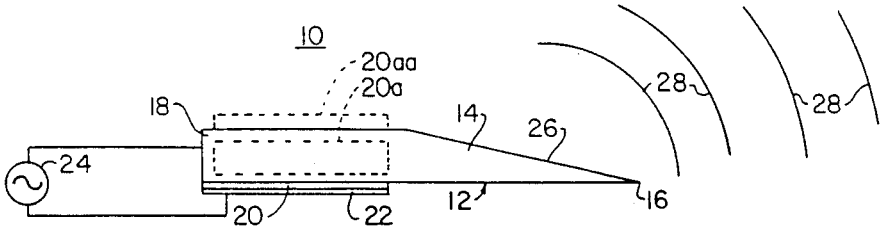
FIG. 1 is a schematic side view of an acoustic pump according to this invention.

There is shown in FIG. 1 an acoustic pump 10 in the form of an ultrasonic blower having a resonant member 12 with an asymmetrically tapered section 14 that tapers to a thin edge 16. Member 12 also includes a generally planar section 18, FIG. 2. A piezoelectric driver 20 is mounted on the resonant member remote from the thin edge 16, although it will work close to the edge as well. It may be mounted on the bottom, as shown in FIG. 1, or on one of the sides 20*a* or the top 20*aa*, as shown in phantom in FIG. 1. An electrode 22 is provided on the outer surface of piezoelectric driver 20 and the resonant member, providing it is sufficiently conductive, may act as the other electrode for applying an oscillating electric current to the piezoelectric drive 20 by means of an alternating current source 24. With the application of the oscillating current, tapered surface 26 vibrates and causes an acoustic streaming effect which pumps air away from thin edge 16, as illustrated by the compressive wave fronts 28. The overall size of resonant member 12 may be approximately 1.075 inches in width, 1.275 inches in length, and 0.25 inch in thickness or height.

Piezoelectric driver 20 may be made of PTS-1512 piezoceramic supplied by Piezo Electric Products, Inc., or the equivalent, approximately 0.98 inch in diameter and 0.01 inch in thickness. The driver may be nickel plated on both sides to form electrode 22 on one side and a binding surface for attachment to the aluminum resonant member 12 using Locktite Type 404 cement or the equivalent.

Figure 3:
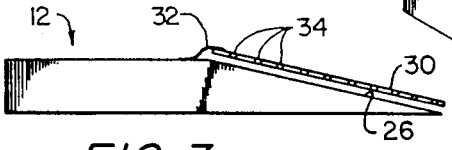
FIG. 3 is a view similar to FIG. 1 showing the resonant member with an amplifying membrane mounted over the tapered surface.
Figure 3A:
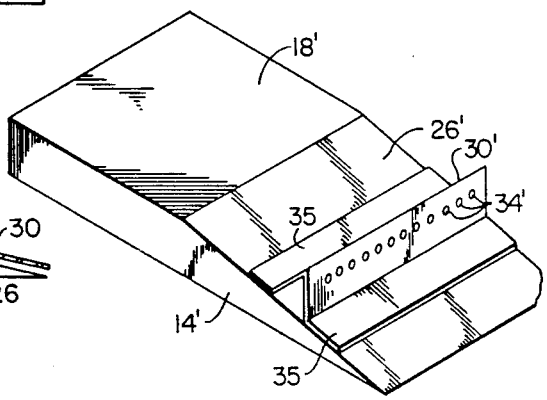
FIG. 3A is an axonometric view of an alternative form of amplifying membrane.
Figure 4:
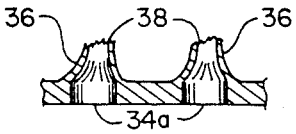
FIG. 4 is an enlarged cross sectional view showing the holes in a portion of the amplifying membrane of FIG. 3.

An amplifying membrane, perforated plate 30 with holes 34, FIG. 3, may be applied by attaching it with a flexible hinge 32 to resonant member 12 so that it floats over tapered surface 26 at the optimum level. This level is self-regulating so that when perforated plate 30 is loosely held in place it automatically levitates above the oscillating tapered surface 26 until it reaches a position of dynamic equilibrium between the acoustic pressure exerted away from the surface 26 and the recoil pressure which is exerted toward the surface 26. Although the membrane is shown above the surface and of generally planar shape, this is not a necessary limitation of the invention. For example the membrane may be mounted spaced from the bottom of the tapered surface and may take the form of an inverted "V" channel 30' with holes 34' facing in the direction of air movement. The flanges 35 may be secured to surface 26' but the perforated portion with holes 34', as in other constructions, is spaced above the surface. The effect of the amplifying membrane is not fully understood in detail; however, it appears that the levitation of the membrane, as explained, occurs at the height at which the downward pressure due to ejected air just balances the upward pressure due to the stream of entrained air below the membrane. It is found that plate 30 works well with approximately 270 holes per square inch having a diameter of 0.007–0.01 inch. Holes have been constructed by punching through a brass plate 0.002 inch thick, 1.075 inches long, and 0.65 inch wide. Good results have been found when the punched holes 34*a*, FIG. 4, have conical protrusions 36 which converge away from surface 26 and end in ragged edges 38. The acoustic pump 10 of FIG. 1 delivers good performance, but its results are even more spectacular when a perforated plate 30 is used in combination with it.

Figure 5:
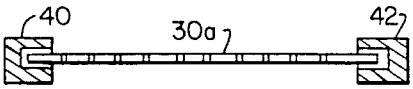
FIG. 5 is an end view with parts in cross section of an alternative mounting for the amplifying membrane.

Resonant member 12 is made of a material having low internal damping, or high "Q", in the range of 300 and higher, such as tempered aluminum or magnesium alloys, carbon steel, glass, or ceramic. Aluminum alloy 6061-T6 is one presently preferred material. Also the resonant member preferably has a stiffness to density ratio of at least $2\times10^9$ dyne-cm/gm, obtained by dividing Young's modulus of the material by the density of the material; e.g. for aluminum this ratio is derived by dividing Young's modulus: $0.7\times10^{12}$ dynes/cm$^2$ by the density of aluminum: 2.7 gms/cm$^3$. Using an aluminum alloy 2024T-561 resonant member driven at its first harmonic with a 34 KHz square wave, and a 12-volt peak-to-peak source, the blower consumes 1.3 watts of power and delivers an air flow of 2 ft.$^3$/min at an average velocity of 475 ft./min., and a peak velocity of 1400 ft./min. with no significant temperature rise. Under these conditions the perforated plate 30 levitates at a height of 0.003 inch above tapered surface 26. When the levitation height is known plate 30*a*, FIG. 5, may be fixed in position at that point by being clamped in suitable mountings which grip it tightly, as shown in mountings 40, 42, or it could be gripped in a mounting which only loosely surrounds the edge of perforated plate 30*a* to enable it to self-regulate its height in the same manner as permitted by flexible hinge 32, FIG. 3.

Figure 6:
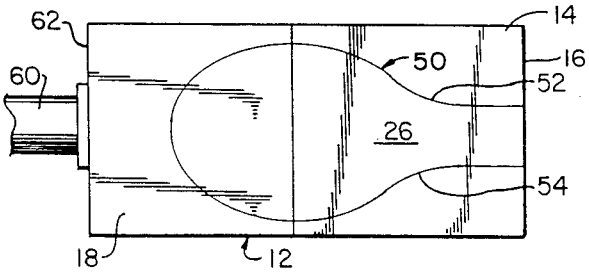
FIG. 6 is a top view showing a mounting technique for and the open node line pattern developed by the resonant member.
Figure 7:
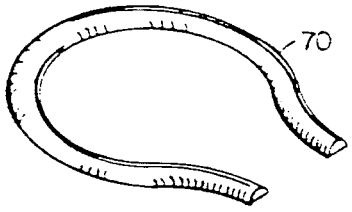
FIG. 7 is an alternative node line mounting member for mounting the resonant member of FIG. 1.

The invention preferably utilizes a node pattern 50, FIG. 6, which is generally circular in shape, is open at the thin edge 16 and contains inflections 52, 54 near edge 16. The perforated plate is preferably located over the inflections. The thin edge is necessary in the configuration of the resonant member 12 in order to produce the open node pattern which results in the high amplitude pumping action that moves the air through the acoustic streaming phenomenon. Resonant member 12 may be mounted to a printed circuit board or other environmental structure by means of an arm 60 mounted to the back side 62 remote from tapered surface 26 and 16; or it may be mounted by using a node pattern support 70, FIG. 7, such as a half round rubber element formed in the shape of node pattern 50 and adhered to the underside of member 12 beneath the node line 50.

Figure 2:
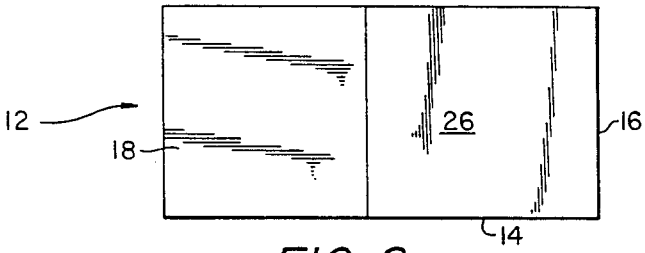
FIG. 2 is a top plan view of the resonant member portion of the pump of FIG. 1.
Figure 8:
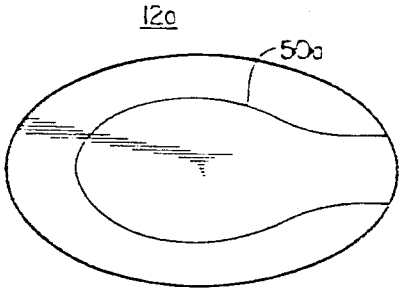
FIG. 8 is a top plan view of an elliptical resonant member showing its node line pattern.
Figure 9:
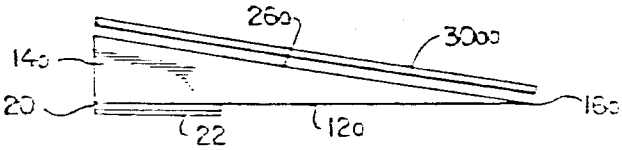
FIG. 9 is a side view of the elliptical member of FIG. 8.

Resonant member 12 is not restricted to the particular shape shown in FIGS. 1 and 2. For example, it may have a generally elliptical shape 12*a*, FIG. 8, which provides the same type of node line pattern 50*a* when it is tapered to a thin edge 16*a*, FIG. 9, and has the same type of tapered surface 26*a*. Elliptical member 12*a*, FIG. 9, does not have the extra generally planar section 18 but includes only the tapered portion 14*a*. Elliptical resonant member 12*a* may be 0.125 inch thick with a 1.35 inch major axis and a 1.25 inch minor axis.

Figure 10:
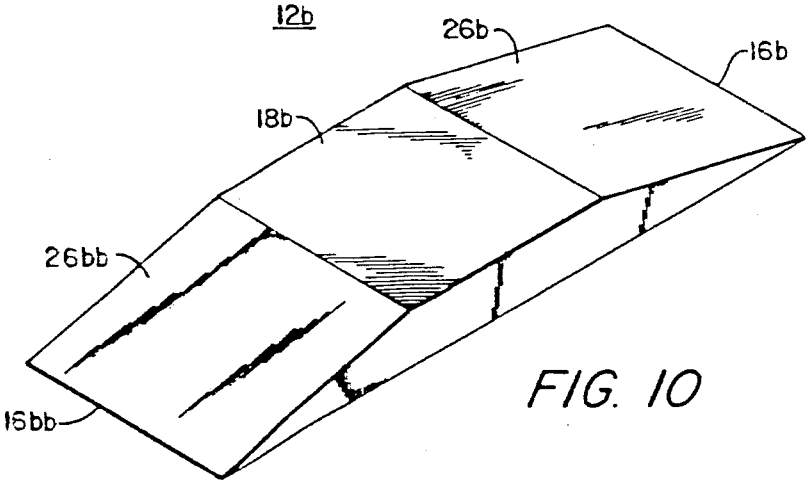
FIG. 10 is a view of a resonant member which has two sections asymmetrically tapered to a thin edge.

The resonant member is not limited to a single thin edge and tapered surface; for example, as shown in FIG. 10, member 12*b* may include a planar section or slab 18*b* which has two tapered surfaces 26*b* and 26*bb* terminating in thin edges 16*b* and 16*bb*, which can be used for similar acoustic pumping using similar acoustic techniques.

Figure 11:
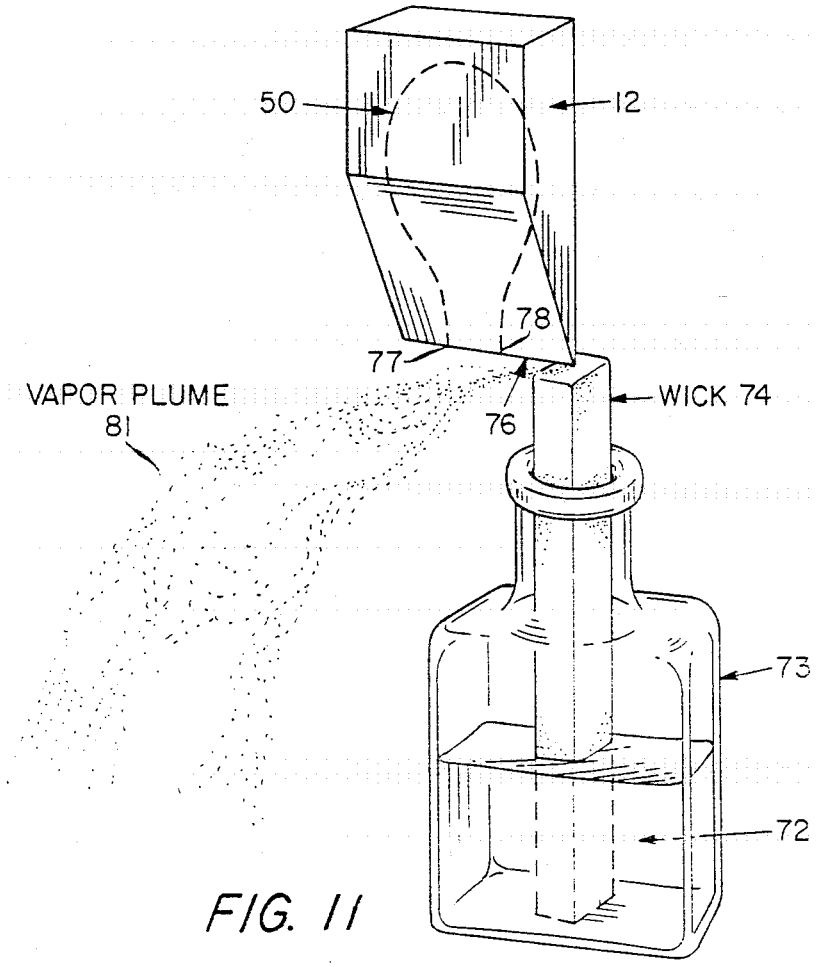
FIG. 11 is an axonometric view of a preferred embodiment of a vaporizer constructed in accordance with the invention.

FIG. 11 illustrates an embodiment of the invention wherein a liquid 72 contained within container 73 is vaporized by resonant member 12. Wick member 74, causes the liquid in the container 73, to be fed by capillary action upwardly to be applied at the lower portion 76 of the resonant member, which is driven by an electronic circuit illustrated schematically in FIG. 12. A major portion of wick 74 contacts the lower edge of the resonant member at an anti-node. As mentioned previously, two vibrational nodes 77 and 78 of loop pattern 50 are present at the lower edge of the resonant member as indicated, whereby the outer portion 76 of the lower edge portion resonants at maximum amplitude. The result is the generation of a vapor plume 81 which causes wide dispersion of vaporized liquid supplied by wick member 74, and hence the apparatus serves simultaneously as a liquid atomizer, and as a fragrance-disseminating blower device, without the need for a blower fan.

Figure 12:
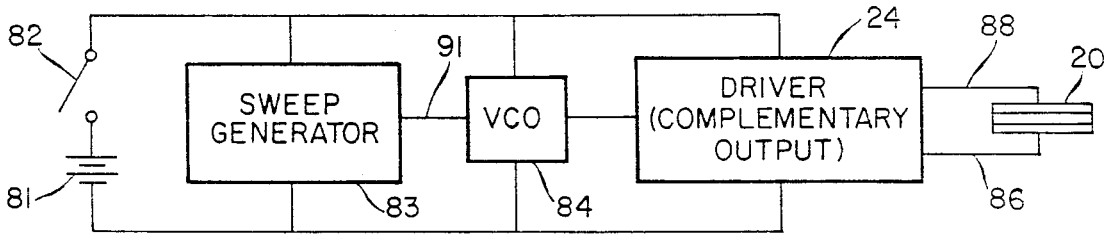
FIG. 12 schematically illustrates an electronic battery operated driver circuit for driving the piezoelectric element attached to the resonant member.

In FIG. 12, an ordinary nine volt battery 81 is coupled via switch 82 to sawtooth sweep generator 83, for sweeping the output frequency of voltage controlled oscillator 84, in turn coupled to a complementary output solid-state driver circuit or 180° phase inverter 24. The complementary driver output leads 86 and 88 are electrically coupled to the thin piezoelectric element 20 previously described, which drives resonant member 12. The electronic driver circuitry of FIG. 12 is employed to produce a variable frequency pulse train which is swept between twenty and eighty kilohertz, so that regardless of variations in the resonant frequency of resonant member 12 due to changing load conditions, the resonant member will thus be driven, at some time during the sweep period of generator 83, at its exact resonant frequency. Driver circuit 24 is a 180° phase inverter circuit alternately applying the battery voltage to leads 86 and 88 in bi-polar fashion, so that, positive plus nine and negative minus nine volt pulses are alternately applied across the piezoeletric element 20 to produce a peak to peak voltage swing of eighteen volts during each vibration cycle; as a result, piezoelectric driver element 20 is bent in a first direction and thereafter in a second direction to produce the to and fro motion induced into resonant member 12. An I.C. #4069B CMOS Hex Inverter was employed as a driver and produced a pulse train of thirty milliamps RMS. Components 24, 83 and 84 are well known to those skilled in the art, and thus the details thereof have not been supplied in the interest of brevity and economy. Pulsating D.C. could also be utilized.

The liquid vaporizer constructed in accordance with the invention, is smaller, takes less power, and may be operated at lower voltages than prior art ultrasonic vaporizers. We have found that an ordinary nine volt battery utilized as previously described, yields excellent results. The volume of vapor produced is profuse, and liquids of relatively low volatility such as water, alcohol, and water-alcohol-oil mixtures have been successfully vaporized; and surprisingly a blower fan is not required. The flow rate of liquid applied to the resonant member should not be excessive; a wick employing capillary action to feed the liquid to the resonant member produces good results. Our currently preferred resonant member 12 has a thickness of 0.1 inches, a length of 0.5 inches and a width of 0.5 inches, and is made of aluminum alloy 6061-T6.

Besides performing as an acoustic air blower pump for cooling various devices such as printed circuit boards, and as a highly efficient vaporizer, resonant member 12 was immersed in a cleaning bath to efficiently introduce ultrasonic energy into the liquid bath for cleaning purposes.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An ultrasonic transducer comprising:

a resonant member having a Q- factor greater than 300 and asymmetrically tapered to a thin edge portion; and an electrically actuated driver mounted on said resonant member for driving said resonant member in the resonant frequency range of said resonant member for causing said resonant member to resonate in an open node line pattern which intersects with said thin edge portion.

2. The ultrasonic transducer of claim 1 wherein said driver includes a thin piezoelectric element having a substantially smaller mass than said resonant member.

3. The ultrasonic transducer of claim 2 further including means for mounting a perforated plate upon said resonant member at the position of dynamic equilibrium between the acoustic pressure away from the surface and the recoil pressure toward said tapered surface.

4. The transducer of claim 2 wherein said electrically actuated driver includes a battery operated pulse train generator for applying pulses to said piezoelectric element having amplitudes of less than about plus and minus 27 volts.

5. The transducer of claim 4 wherein said pulses have amplitudes of about plus or minus 9 volts.

6. An atomizer for converting a liquid into a vapor comprising:

a resonant member tapered to a thin edge portion and having a Q-factor greater than 300, and a stiffness to density ratio greater than $2\times10^9$ dyne-cm/gram;

a driver directly coupled to said resonant member;

means for applying a pulsating voltage to said driver for causing said resonant member to resonate in an open node line pattern which intersects with said thin edge portion; and supply means for supplying said liquid to said resonant member adjacent said thin edge portion at a flow rate to produce atomization of said liquid.

7. The atomizer of claim 6 wherein said driver includes a thin piezoelectric element having a substantially smaller mass than said resonant member.

8. The atomizer of claim 7 wherein said means for applying said pulsating voltage comprises a battery operated voltage driver for producing a pulse train having voltage pulses of less than plus and minus twenty seven volts.

9. The atomizer of claim 8 wherein said voltage pulses have amplitudes of about plus and minus nine volts.

10. The atomizer of claim 8 wherein said pulse train is swept in frequency between twenty and eighty kilohertz.

11. The atomizer of claim 9 wherein said pulse train is swept in frequency between twenty and eighty kilohertz.

12. The atomizer of claim 6 where said member is asymmetrically tapered to said thin edge portion.

13. The ultrasonic transducer of claim 6 wherein said resonant member is made of a material selected from the group consisting of tempered aluminum alloys, carbon steel, glass and ceramic.

14. The atomizer of claim 6 wherein said supply means comprises a wick-like member for supplying said liquid to said resonant member.

15. The atomizer of claim 6 in which said supply means supplies said liquid to said resonant member at an anti-node of said resonant member.

16. The atomizer of claim 14 in which said wick-like member contacts said resonant member at an anti-node of said resonant member.

17. An ultrasonic air blower comprising:

a resonant member tapered to a thin edge portion and having a Q-factor greater than three hundred, and a stiffness to density ratio greater than $2\times10^9$ dyne-cm/gram;

a thin piezoelectric driver having a substantially smaller mass than said resonant member and mounted thereon; and means for applying a pulsating voltage to said driver in the resonant range of said resonant member for vibrating said resonant member in a open node line pattern which intersects with said thin edge portion to induce motion of said air.

18. The air blower of claim 17 wherein said resonant member is asymmetrically tapered to said thin edge.

19. An atomizer for converting a liquid into a vapor comprising:

a resonant member asymmetrically tapered to a thin edge portion and having a Q-factor greater than 300, and a stiffness to density ratio greater than $2\times10^9$ dyne-cm/gram;

a driver directly coupled to said resonant member, said driver including a thin piezoelectric element having a substantially smaller mass than said resonant member;

means for applying a pulsating voltage to said driver for causing said resonant member to resonate in an open node line pattern which intersects with said thin edge portion; and supply means for supplying said liquid to said resonant member adjacent said thin edge portion at an anti-node of said resonant member and at a flow rate to produce atomization of said liquid.

* * * * *